US009224314B2

(12) United States Patent
Igarashi

(10) Patent No.: US 9,224,314 B2
(45) Date of Patent: Dec. 29, 2015

(54) IDENTIFICATION LABEL UNIT

(71) Applicant: Power Support Co., Ltd., Tokyo (JP)

(72) Inventor: Katsushi Igarashi, Tokyo (JP)

(73) Assignee: Power Support Co., Ltd., Tokyo (JP)

( * ) Notice: Subject to any disclaimer, the term of this patent is extended or adjusted under 35 U.S.C. 154(b) by 0 days.

(21) Appl. No.: 14/684,935

(22) Filed: Apr. 13, 2015

(65) Prior Publication Data

US 2015/0310774 A1 Oct. 29, 2015

(30) Foreign Application Priority Data

Apr. 25, 2014 (JP) ..... 2014-090992

(51) Int. Cl.
*G09F 3/18* (2006.01)

(52) U.S. Cl.
CPC ..... *G09F 3/185* (2013.01)

(58) Field of Classification Search
CPC ..... G09F 3/185; G09F 3/201; B41M 3/14; B41M 3/148
USPC ..... 283/90
See application file for complete search history.

(56) References Cited

U.S. PATENT DOCUMENTS

| | | | | |
|---|---|---|---|---|
| 2,545,262 | A * | 3/1951 | Coleman | A45C 13/42 40/649 |
| 5,732,980 | A * | 3/1998 | DeRose et al. | B41M 3/14 283/58 |
| 2003/0035191 | A1* | 2/2003 | Moia | G06K 19/06046 359/281 |
| 2011/0031139 | A1* | 2/2011 | Macor | B01L 3/508 206/232 |
| 2014/0283424 | A1* | 9/2014 | Cope | G09F 3/185 40/303 |
| 2015/0210107 | A1* | 7/2015 | Nugent | B42D 25/00 283/77 |

* cited by examiner

*Primary Examiner* — Gary Hoge
(74) *Attorney, Agent, or Firm* — Maier & Maier, PLLC

(57) ABSTRACT

An identification label unit capable of allowing authenticity determination of a product is provided.
According to the present invention, an identification label unit, including: an identification label provided with an identifier; a viewer plate to cover the identification label; and a retaining member to retain the identification label and the viewer plate so as to allow relative rotation of the identification label or the viewer plate with respect to each other; wherein: display and non-display of the identification label is switched by relative rotation of the identification label or the viewer plate with respect to each other, is provided.

11 Claims, 6 Drawing Sheets

IDENTIFICATION LABEL UNIT

BACKGROUND OF THE INVENTION

1. Field of the Invention

The present invention relates to an identification label unit which enables authenticity determination of a product.

2. Background of the Invention

There are many imitators who try to obtain unfair profit by counterfeiting competitor's products. Imitative technologies are advancing, and thus it has become difficult for the users to determine whether the product they are intending to buy is a genuine product or is a copy product. Accordingly, there are many users who purchase the copy product while believing that the product is a genuine product. Since such users are in belief that they have purchased a genuine product, the low quality of the copy product would result in recognition that the genuine product has low quality, leading to establishment of unfavorable brand image. In addition, in a case where the copy product shows the contact information for the company of the genuine product, complaint handling and inquiry handling would require extra work to the personnel of the company of the genuine product, affecting their original operations.

In order to prevent such damage stemming from the copy product, anti-counterfeiting labels utilizing hologram can be provided onto the genuine product. However, the imitators have acquired the technique to imitate such anti-counterfeiting labels, and thus there is a problem that the anti-counterfeiting effect of the label has extremely decreased.

SUMMARY OF THE INVENTION

Problem to be Solved by the Invention

Under these circumstances, a new anti-counterfeiting technique "anti-counterfeiting label FORGE GUARD (registered trademark)" to take place of hologram has been developed by FUJIFILM Corporation. FORGE GUARD is made by providing an image for identification onto a dedicated film subjected to a special treatment. Accordingly, it is an anti-counterfeiting label which is extremely difficult for the imitators to imitate. The image of the FORGE GUARD cannot be observed by naked eye, and can be observed only after being observed through a viewer plate. Therefore, authenticity determination of a product provided with the FORGE GUARD requires the viewer plate. When the viewer plate is not available, the product appears as merely having a silver seal being attached thereon.

The viewer plate is generally in the form of a card, and is distributed separately from the FORGE GUARD. Therefore, in order to prevent purchase of copy products, the viewer plate need be provided near the product when the product is being sold at a store, so that the user himself can use the viewer plate to conduct the authenticity determination.

However, there are many cases where the store does not provide any viewer plate, or the user does not notice that authenticity determination can be done using the viewer plate when purchasing the product. Therefore, although FORGE GUARD itself is an excellent anti-counterfeiting technique, the effect of preventing the user from purchasing the copy product is limited. Accordingly, a technique to realize effective authenticity determination using FORGE GUARD is desired.

The present invention has been made by taking these circumstances into consideration. An object of the present invention is to provide an identification label unit which enables authenticity determination of a product.

Means to Solve the Problem

According to an aspect of the present invention, an identification label unit, comprising: an identification label provided with an identifier; a viewer plate to cover the identification label; and a retaining member to retain the identification label and the viewer plate so as to allow relative rotation of the identification label or the viewer plate with respect to each other; wherein: display and non-display of the identification label is switched by relative rotation of the identification label or the viewer plate with respect to each other, is provided.

The point of the present invention is that not only that the identification label and the viewer plate are integrally retained, but are retained so as to allow relative rotation of the identification label or the viewer plate with respect to each other. Accordingly, the user can easily conduct authenticity determination by rotating the identification label or the viewer plate with respect to each other to confirm that the identifier is displayed or not displayed. Here, in a case where the identification label and the viewer plate cannot be rotated relatively with respect to each other, the user can confirm that the identifier is displayed in the identification label, but cannot confirm that the identifier would not be displayed when the viewer plate is removed. In such circumstances, the imitator can easily manufacture a copy product having a normal label displaying the identifier and a plastic plate placed on the label. Accordingly, such configuration cannot realize the anti-counterfeiting effect. Therefore, the viewer plate was conventionally provided separately from the FORGE GUARD, and was not integrated with the FORGE GUARD. Instead of the concept to switch the displaying/non-displaying of the identifier by the presence or non-presence of the viewer plate, the present inventor has arrived at a concept to switch the displaying/non-displaying of the identifier by rotating the viewer plate or the identification label with respect to each other. Accordingly, the present inventor has arrived at a concept to structure an identification label unit comprising the viewer plate and the identification label, thereby leading to completion of the present invention.

Hereinafter, various embodiments of the present invention will be provided. Here, these embodiments can be combined with each other.

Preferably, the retaining member comprises: a bottom base to retain the identification label and the viewer plate so as to allow relative rotation of the identification label or the viewer plate with respect to each other.

Preferably, the identification label is fixed to the bottom base; and the viewer plate is retained so as to allow relative rotation with respect to the bottom base.

Preferably, the retaining member comprises a top base fixed to the bottom base; and the viewer plate is retained in a retaining space provided in between the bottom base and the top base, the viewer plate being retained so as to rotate with respect to the identification label.

Preferably, the top base is constructed so as to allow visual observation of the identifier through the viewer plate.

Preferably, the identification label unit further comprises a reception concavity provided to the bottom base to accommodate the identification label, the viewer plate, and the top base; wherein a surface of the top base and a surface of the bottom base are positioned on substantially the same plane.

Preferably, the bottom base is capable of being fixed to a product.

Preferably, the bottom base is a product package.

Preferably, the viewer plate is fixed to the bottom base; and the identification label is retained so as to rotate with respect to the bottom base.

Preferably, the identification label is retained in between the bottom base and the viewer plate.

Preferably, the viewer plate further comprises a projection protruding in a direction towards outside of the retaining member.

BRIEF DESCRIPTION OF THE DRAWINGS

The above further objects, features and advantages of the present invention will become more apparent from the following detailed description taken in conjunction with the accompanying drawings, wherein.

DESCRIPTION OF THE PREFERRED EMBODIMENTS

Hereinafter, the embodiments of the present invention will be described with reference to the drawings. The following embodiments are merely an example, and thus the present invention shall not be limited to these.

1. First Embodiment

Figure 1B:
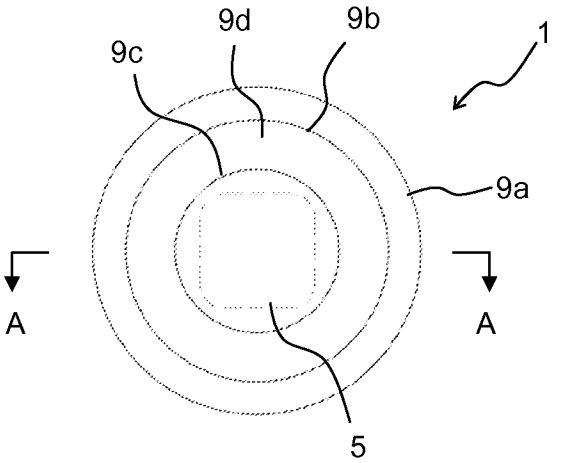
FIG. 1B is a plan view of identification label unit 1 according to the first embodiment of the present invention.

The identification label unit 1 according to the first embodiment of the present invention will be explained with reference to FIGS. 1A to 1C.

The identification label unit 1 comprises a bottom base 3, an identification label 5 fixed onto the bottom base 3, a viewer plate 7 arranged so as to cover the identification label 5, and a top base 9 fixed to the bottom base 3 so that the identification label 5 and the viewer plate 7 are sandwiched in between the bottom base 3 and the top base 9. The "retaining member" is structured by the bottom base 3 and the top base 9.

The identification label 5 is provided with an identifier, such as a logo of the brand for example. The identifier is structured so that the displaying/non-displaying of the identifier can be switched by rotating the identification label 5 or the viewer plate 7 with respect to each other. As an example of such identification label 5, FORGE GUARD available from FUJIFILM Corporation can be mentioned. As the viewer plate 7, the viewer dedicated for the FORGE GUARD available from FUJIFILM Corporation can be used, or a commercially available polarization plate can be used. The identifier can be either a color identifier or a monochrome identifier. Here, the color identifier is preferable since the identification label 5 having the color identifier is more difficult to manufacture. The displaying/non-displaying of the identifier can be switched with rotation by every 45 degrees for example. Here, the switching is not limited to such, and the switching can be conducted with rotation by every 90 degrees.

The top base 9 comprises a base portion 9*a* fixed onto the bottom base 3, a cylindrical portion 9*b* rising from the base portion 9*a*, and a retaining wall portion 9*d* provided on one end of the cylindrical portion 9*b*. The retaining wall portion 9*d* is provided so as to rim the window portion 9*c*. The window portion 9*c* is provided so as to allow visual observation of the identifier via the viewer plate 7. In the present embodiment, the window portion 9*c* is an opening.

Figure 1C:
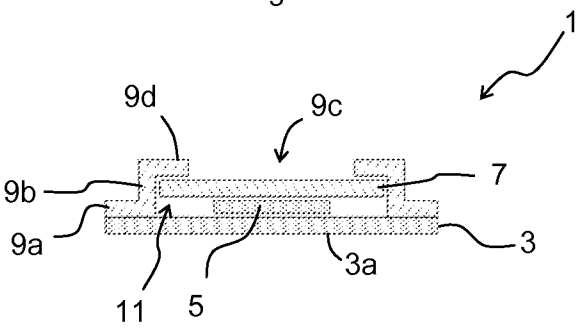
FIG. 1C is a cross sectional view (cross section A-A in FIG. 1B) of identification label unit 1 according to the first embodiment of the present invention.
Figure 1A:
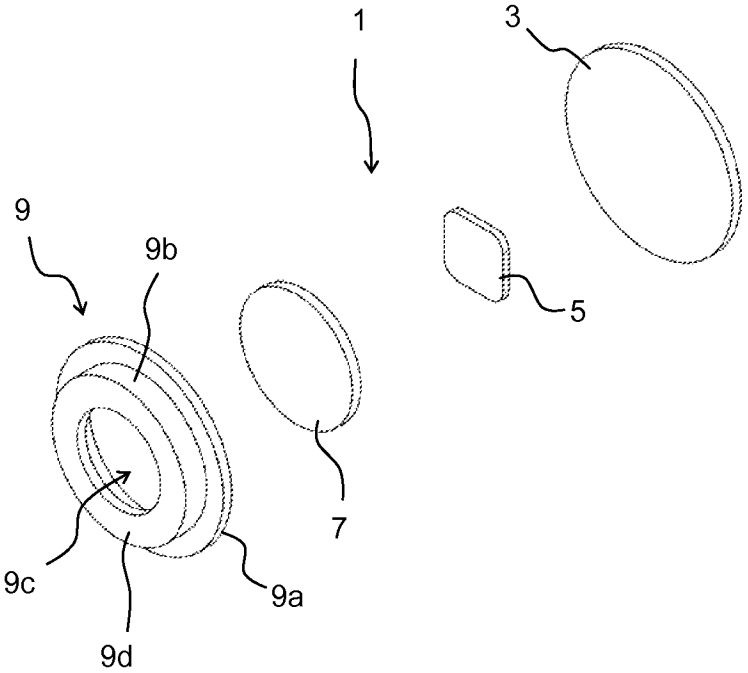
FIG. 1A is an exploded perspective view of identification label unit 1 according to the first embodiment of the present invention.

As shown in FIG. 1C, the base portion 9*a* of the top base 9 is fixed onto the bottom base 3, thereby structuring a retaining space 11 for retaining the identification label 5 and the viewer plate 7 in between the top base 9 and the bottom base 3. The diameter of the cylindrical portion 9*b* is larger than the diameter of the viewer plate 7, and thus the viewer plate 7 is not fixed in the retaining space 11, and is capable of being rotated with respect to the identification label 5. In addition, the diameter of the window portion 9*c* is smaller than the diameter of the viewer plate 7, and thus the viewer plate 7 is retained in the retaining space 11.

An adhesive layer is provided on the rear side 3*a* of the bottom base 3, and thus the identification label unit 1 can be fixed onto the product easily by adhesion. Here, there is no particular limitation regarding the conditions of fixing the bottom base 3 to the product. The bottom base 3 can be fixed onto the product by adhesion, insertion (by structural condition), and the like.

Hereinafter, a method for conducting authenticity determination of the product using the identification label unit 1 is explained.

In one case, the identification label unit 1 is adhered on a product. A user having an intension to purchase the product would rotate the viewer plate 7 in order to determine whether the product is a genuine product or not. The viewer plate 7 can be rotated by directly touching the viewer plate 7 with the finger through the window portion 9*c*. The identification label 5 is structured so that when the viewer plate 7 is rotated by 45 degrees from the condition where the identifier is displayed, the identifier would not be displayed, and when the viewer plate 7 is further rotated by 45 degrees, the identifier would be displayed again. Therefore, when the user rotates the viewer plate 7 and observes that the identifier would be displayed or not displayed in accordance with such rotation, the user can determine that the product intended to purchase is a genuine product. Here, it is preferable that there is a notification on the product package that the product can be confirmed as a genuine product if the displaying/non-displaying of the identifier is switched in accordance with the rotation of the viewer plate 7.

In another case, an object which at first sight seems to be the identification label unit 1 is provided on the product. However, when the user who intends to purchase this product rotates the plate resembling the viewer plate 7, the displaying/non-displaying of the identifier would not be switched. Accordingly, the user can determine that the product is not a genuine product, and can avoid purchasing a copy product.

2. Second Embodiment

Figure 2B:
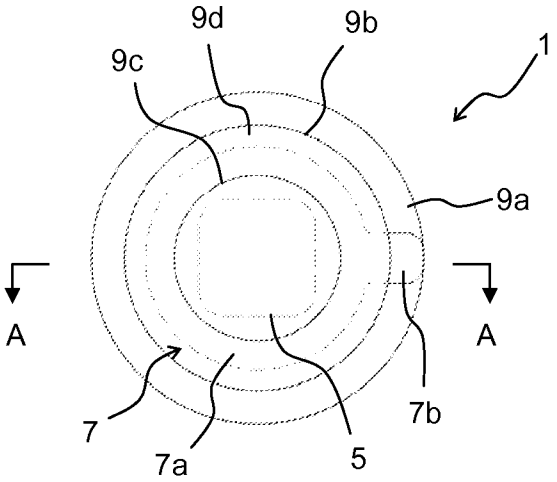
FIG. 2B is a plan view of identification label unit 1 according to the second embodiment of the present invention.
Figure 2C:
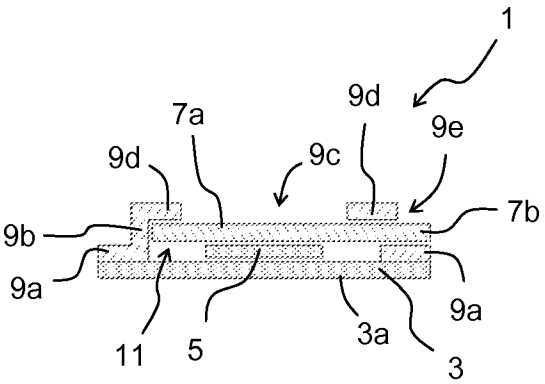
FIG. 2C is a cross sectional view (cross section A-A in FIG. 2B) of identification label unit 1 according to the second embodiment of the present invention.
Figure 2A:
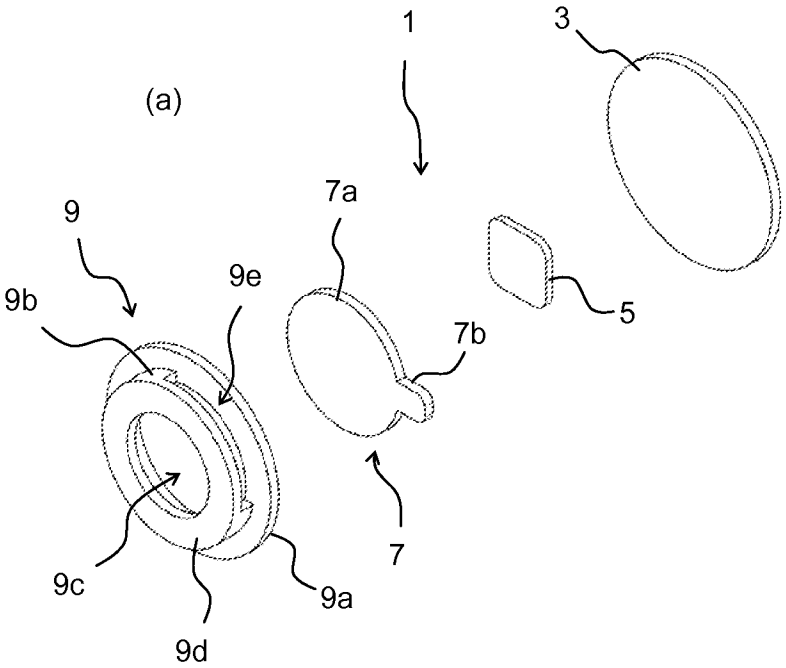
FIG. 2A is an exploded perspective view of identification label unit 1 according to the second embodiment of the present invention.

The identification label unit 1 according to the second embodiment of the present invention will be explained with reference to FIGS. 2A to 2C. The second embodiment is similar with the first embodiment, and differs from the first embodiment mainly in the point that a projection 7*b* protruding in a direction toward outside the retaining member is provided to the viewer plate 7. Explanation will be provided hereinafter mainly for the point of difference.

In the present embodiment, the viewer plate 7 is structured with a main body portion 7*a*, and a projection 7*b* protruding from the main body portion 7*a* towards outside of the main body portion 7*a* in the direction of the radius. A rotation groove 9*e* is provided in the cylindrical portion 9*b* of the top base 9, so as to allow the projection 7*b* to be inserted.

According to such constitution, the projection 7*b* can be used to rotate the viewer plate 7. Therefore, the viewer plate 7 can be rotated more easily compared with the first embodiment. In addition, in the present embodiment, it is not necessary to provide access to the viewer plate 7 through the window portion 9*c*, and thus the window portion 9*c* can be formed with a transparent plate instead of providing the window portion 9*c* as an opening. Otherwise, the top base 9 can be formed entirely with a transparent material, instead of providing the window portion 9*c*.

3. Third Embodiment

Figure 3B:
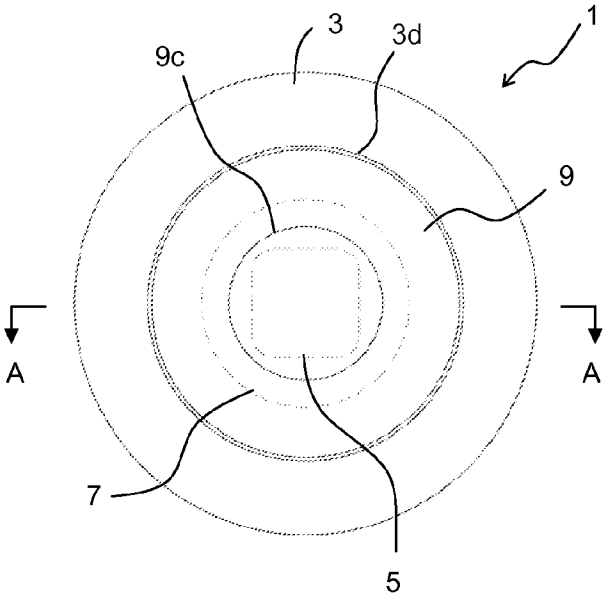
FIG. 3B is a plan view of identification label unit 1 according to the third embodiment of the present invention.
Figure 3C:
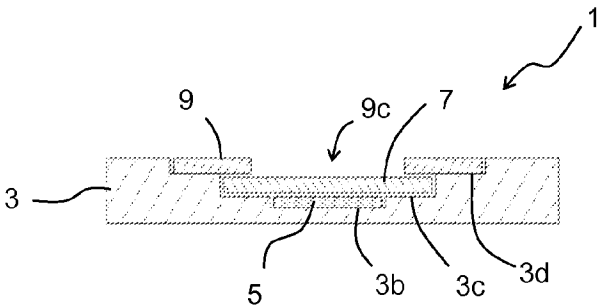
FIG. 3C is a cross sectional view (cross section A-A in FIG. 3B) of identification label unit 1 according to the third embodiment of the present invention.
Figure 3A:
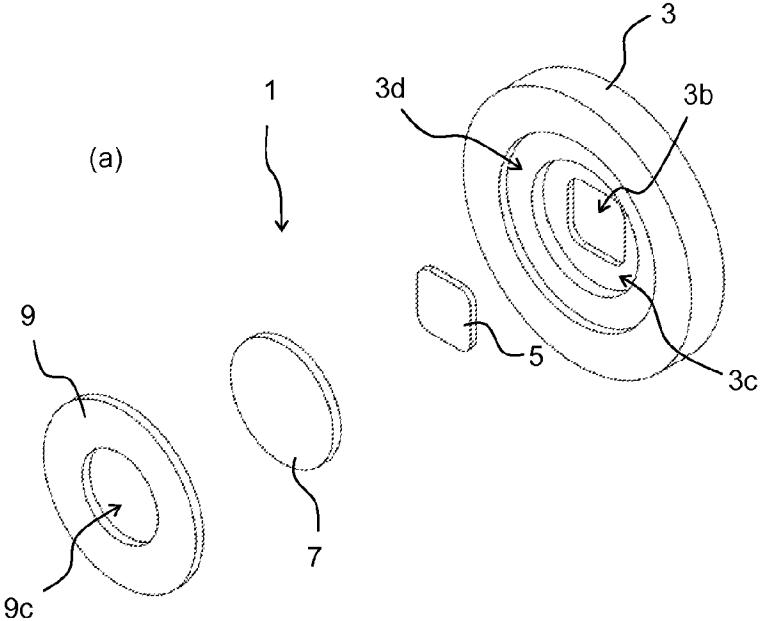
FIG. 3A is an exploded perspective view of identification label unit 1 according to the third embodiment of the present invention.

The identification label unit 1 according to the third embodiment of the present invention will be explained with reference to FIGS. 3A to 3C. The third embodiment is similar with the first embodiment, and differs from the first embodiment mainly in the structure of the retaining member. Explanation will be provided hereinafter mainly for the point of difference.

In the present embodiment, the bottom base 3 comprises reception concavities 3*b*, 3*c*, and 3*d* for accommodating the identification label 5, the viewer plate 7, and the top base 9, respectively. The identification label 5 and the top base 9 are fixed onto the bottom base 3, and the viewer plate 7 is rotatably retained. The depth of the reception concavities 3*b*, 3*c*, and 3*d* become shallow in this order. The depth of the reception concavity 3*d* is approximately the same as the thickness of the top base 9. Therefore, when the top base 9 is arranged inside the reception concavity 3*d*, the surfaces of the bottom base 3 and the top base 9 are positioned on substantially the same plane.

Figure 4B:
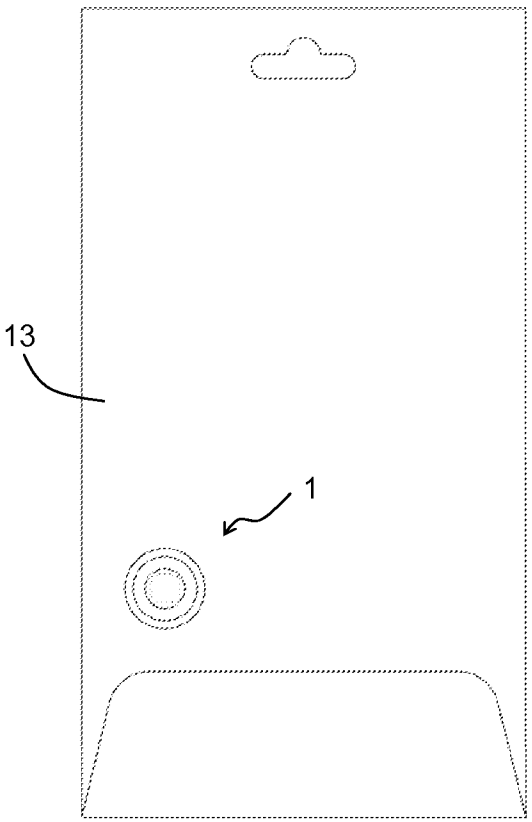
FIGS. 4A and 4B are examples of product package capable of retaining identification label unit 1 of the present invention.
Figure 4A:
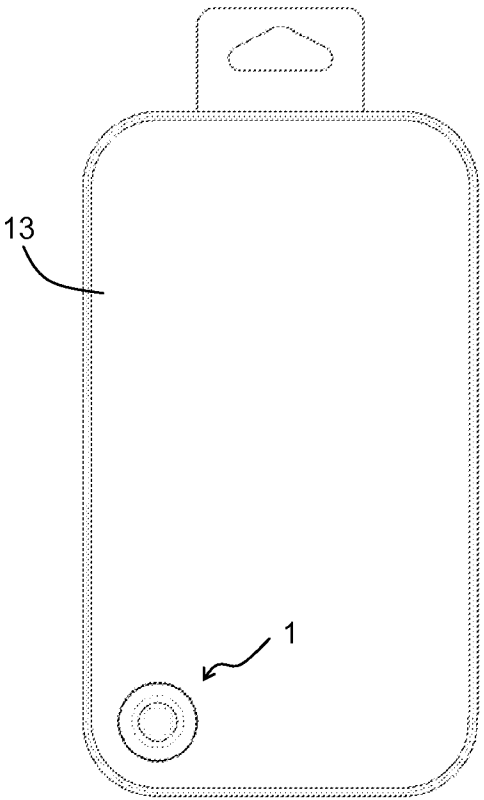

It is preferable that the identification label unit 1 of the present embodiment is applied by incorporating the identification label unit 1 into the product package 13 as shown in FIGS. 4A and 4B. Specifically, the resin plate at the rear side of the product package 13 is used as the bottom base 3. That is, the reception concavities 3*b*, 3*c*, and 3*d* are formed in the resin plate at the rear side beforehand, and then the identification label 5, the viewer plate 7, and the top base 9 are each accommodated in the reception concavities 3*b*, 3*c*, and 3*d*, respectively. As such, the product package 13 can be equipped with the identification label unit 1. The present embodiment is advantageous in the point that the identification label unit 1 would not protrude from the rear side of the product package 13. In addition, although the first and the second embodiments had the possibility of the identification label unit 1 being removed entirely from the product and being re-used for the copy product, the present embodiment can reduce such risk by structuring the resin plate so as to be destroyed at the time of opening of the package.

In the present embodiment, the viewer plate 7 can be rotated by directly touching the viewer plate 7 with the finger through the window portion 9*c*.

4. Fourth Embodiment

Figure 5B:
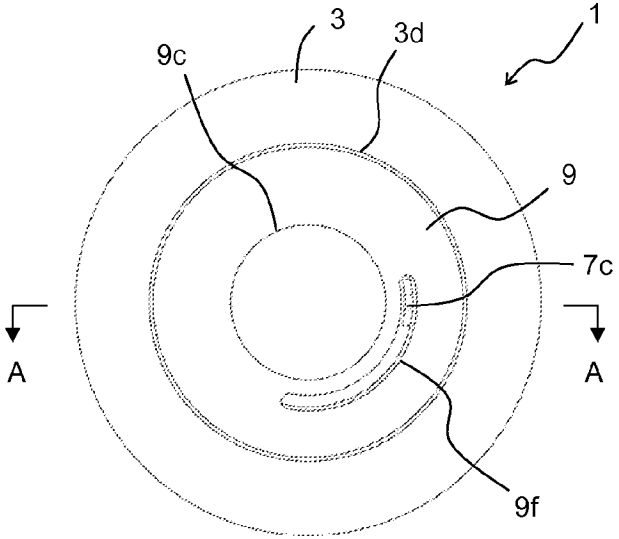
FIG. 5B is a plan view of identification label unit 1 according to the fourth embodiment of the present invention.
Figure 5C:
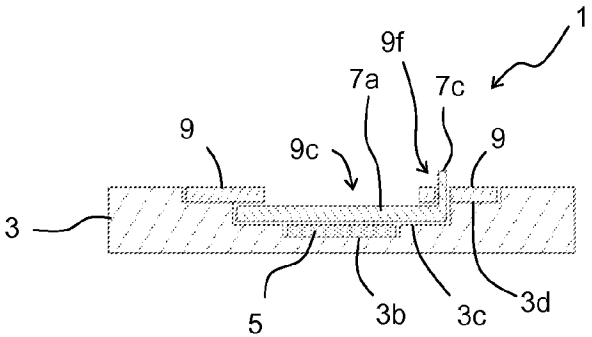
FIG. 5C is a cross sectional view (cross section A-A in FIG. 5B) of identification label unit 1 according to the fourth embodiment of the present invention.
Figure 5A:
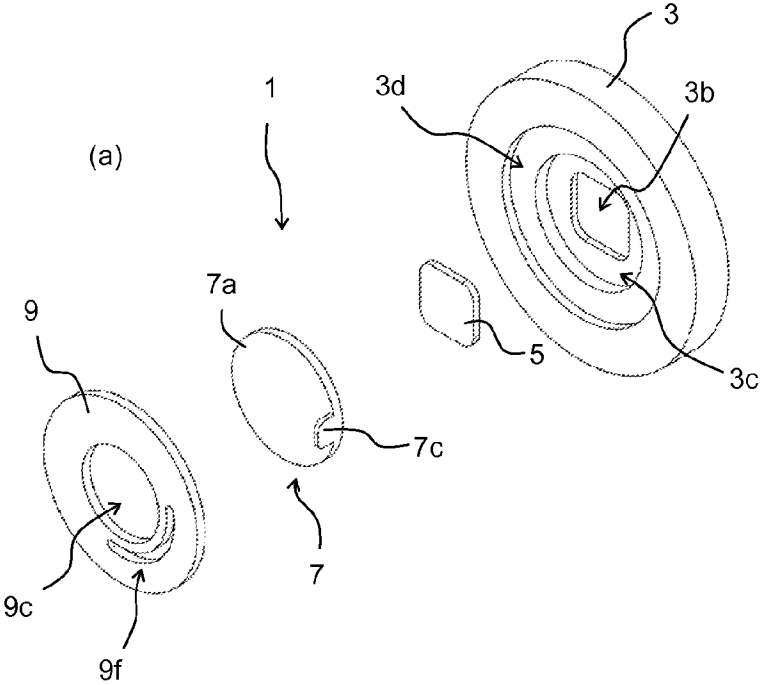
FIG. 5A is an exploded perspective view of identification label unit 1 according to the fourth embodiment of the present invention.

The identification label unit 1 according to the fourth embodiment of the present invention will be explained with reference to FIGS. 5A to 5C. The fourth embodiment is similar with the third embodiment, and differs from the third embodiment mainly in the point that a projection 7*c* protruding in a direction towards outside the retaining member is provided to the viewer plate 7. Explanation will be provided hereinafter mainly for the point of difference.

In the present embodiment, the viewer plate 7 comprises a main body portion 7*a*, and a projection 7*c* protruding from the main body portion 7*a* towards outside of the main body portion 7*a* in a direction towards the top base 9 and perpendicular to the main body portion 7*a*. The top base 9 is provided with a rotation groove 9*f* for allowing the projection 7*c* to be inserted.

According to such constitution, the projection 7*c* can be used to rotate the viewer plate 7. Therefore, the viewer plate 7 can be rotated more easily compared with the third embodiment. In addition, in the present embodiment, it is not necessary to provide access to the viewer plate 7 through the window portion 9*c*, and thus the window portion 9*c* can be formed with a transparent plate instead of providing the window portion 9*c* as an opening. Otherwise, the top base 9 can be formed entirely with a transparent material, instead of providing the window portion 9*c*.

5. Fifth Embodiment

Figure 6B:
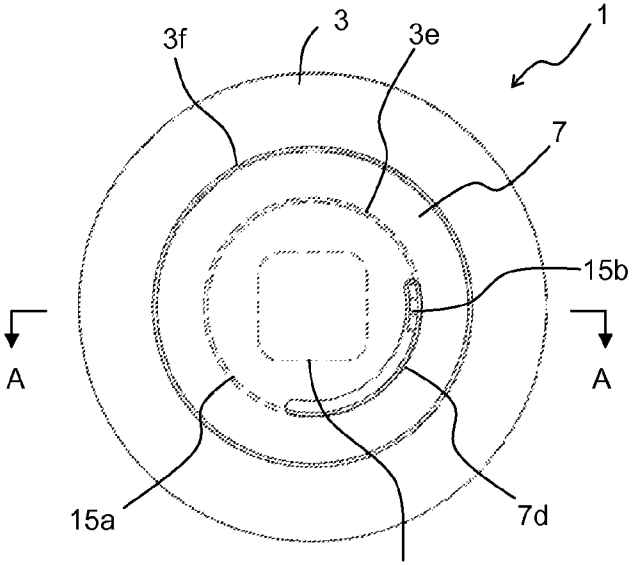
FIG. 6B is a plan view of identification label unit 1 according to the fifth embodiment of the present invention.
Figure 6C:
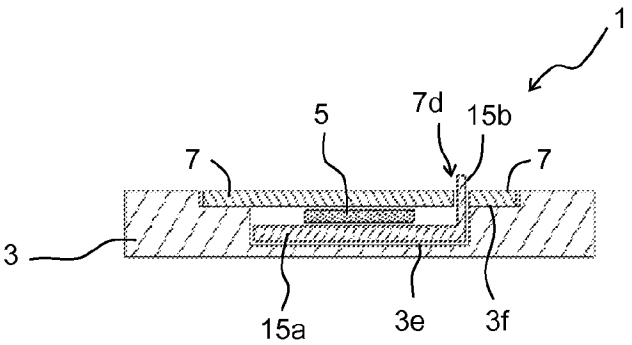
FIG. 6C is a cross sectional view (cross section A-A in FIG. 6B) of identification label unit 1 according to the fifth embodiment of the present invention.
Figure 6A:
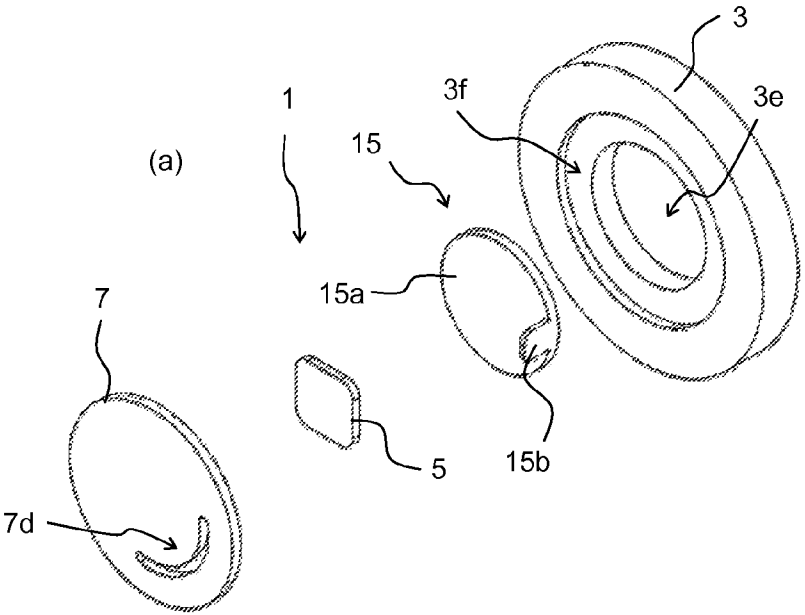
FIG. 6A is an exploded perspective view of identification label unit 1 according to the fifth embodiment of the present invention.

The identification label unit 1 according to the fifth embodiment of the present invention will be explained with reference to FIGS. 6A to 6C. The fifth embodiment is similar with the fourth embodiment, and differs from the fourth embodiment mainly in the point that the viewer plate 7 is fixed and the identification label 5 is rotated. Explanation will be provided hereinafter mainly for the point of difference.

In the present embodiment, the identification label 5 is fixed to the main body portion 15*a* of the rotation plate 15. The rotation plate 15 is provided with a projection 15*b* protruding from the main body portion 15*a* towards outside of the main body portion 15*a* in the direction towards the viewer plate 9 and perpendicular to the rotation plate 15. The projection 15*b* is inserted in a rotation groove 7*d* provided to the viewer plate 7. The bottom base 3 comprises a reception concavity 3*e* for accommodating the rotating plate 15 having fixed thereon the identification label 5, and a reception concavity 3*f* for accommodating the viewer plate 7. The viewer plate 7 is fixed to the bottom base 3, and the rotating plate 15 is rotatably retained. The depth of the reception concavity 3*f* is approximately the same as the thickness of the viewer plate 7. Therefore, when the viewer plate 7 is arranged inside the reception concavity 3*f*, the surfaces of the bottom base 3 and the viewer plate 7 are positioned on substantially the same plane.

With the identification label unit 1 structured as such, the user can rotate the rotating plate 15 using the projection 15*b* of the rotating plate 15, thereby achieving relative rotation of the identification label 5 with respect to the viewer plate 7.

6. Other Embodiments

In the afore-mentioned embodiments, either one of the identification label 5 or the viewer plate 7 was fixed and the other was rotatably retained. Here, the retaining member can rotatably retain both of the identification label 5 and the viewer plate 7.

In the afore-mentioned embodiments, the top base 9 was arranged so as to come in contact with the circumference of the viewer plate 7, and thus the viewer plate 7 was rotatably retained. In another constitution, a pin can be pressed through the viewer plate 7 and the identification label 5 instead of providing the top base 9. Accordingly, the viewer plate 7 is rotatably retained having the pin as its rotation center.

Further, the viewer plate 7 can be fixed to the top base 9, and the top base 9 can be arranged so as to rotate with respect to the bottom base 3.

EXPLANATION OF SYMBOLS

1: identification label unit
3: bottom base
5: identification label
7: viewer plate
9: top base
13: product package
15: rotating plate Although various exemplary embodiments have been shown and described, the invention is not limited to the embodiments shown. Therefore, the scope of the invention is intended to be limited solely by the scope of the claims that follow.

What is claimed is:

1. An identification label unit, comprising:
an identification label provided with an identifier;
a viewer plate to cover the identification label; and
a retaining member to retain the identification label and the viewer plate so as to allow relative rotation of the identification label or the viewer plate with respect to each other; wherein:
display and non-display of the identification label is switched by relative rotation of the identification label or the viewer plate with respect to each other.

2. The identification label unit of claim 1, wherein the retaining member comprises:
a bottom base to retain the identification label and the viewer plate so as to allow relative rotation of the identification label or the viewer plate with respect to each other.

3. The identification label unit of claim 2, wherein
the identification label is fixed to the bottom base; and
the viewer plate is retained so as to allow relative rotation with respect to the bottom base.

4. The identification label unit of claim 2, wherein
the retaining member comprises a top base fixed to the bottom base; and
the viewer plate is retained in a retaining space provided in between the bottom base and the top base, the viewer plate being retained so as to rotate with respect to the identification label.

5. The identification label unit of claim 4, wherein the top base is constructed so as to allow visual observation of the identifier through the viewer plate.

6. The identification label unit of claim 3, further comprising:
a reception concavity provided to the bottom base to accommodate the identification label, the viewer plate, and the top base; wherein
a surface of the top base and a surface of the bottom base are positioned on substantially the same plane.

7. The identification label unit of claim 2, wherein the bottom base is capable of being fixed to a product.

8. The identification label unit of claim 2, wherein the bottom base is a product package.

9. The identification label unit of claim 2, wherein
the viewer plate is fixed to the bottom base; and
the identification label is retained so as to rotate with respect to the bottom base.

10. The identification label unit of claim 9, wherein the identification label is retained in between the bottom base and the viewer plate.

11. The identification label unit of claim 1, wherein the viewer plate further comprises a projection protruding in a direction towards outside of the retaining member.

* * * * *